US006178576B1

(12) United States Patent
Newell

(10) Patent No.: US 6,178,576 B1
(45) Date of Patent: Jan. 30, 2001

(54) DEFLECTOR ATTACHMENT FOR AN ADJUSTABLE BED

(76) Inventor: Jack L. Newell, 1502 - 21ST Ave., SE., Ruskin, FL (US) 33570

( * ) Notice: Under 35 U.S.C. 154(b), the term of this patent shall be extended for 0 days.

(21) Appl. No.: 09/288,305

(22) Filed: Apr. 8, 1999

(51) Int. Cl.[7] ..... A61G 7/012; A47C 21/00
(52) U.S. Cl. ..... 5/658; 5/663; 5/424; 248/345.1
(58) Field of Search ..... 5/600, 658, 663, 5/510, 286, 280, 424; 248/345.1

(56) References Cited

U.S. PATENT DOCUMENTS

| | | | | |
|---|---|---|---|---|
| D. 212,448 | | 10/1968 | Tosler | D66/2 |
| 1,017,153 | | 2/1912 | Kampe . | |
| 1,043,370 | * | 11/1912 | Stubbs | 248/345.1 |
| 1,440,783 | | 1/1923 | Kiley . | |
| 1,557,445 | | 10/1925 | Euller . | |
| 4,016,613 | * | 4/1977 | Benoit et al. | 5/663 |
| 4,062,075 | | 12/1977 | Stern et al. | 5/63 |
| 4,095,372 | | 6/1978 | Rittner | 49/460 |
| 4,391,007 | | 7/1983 | Mitchell et al. | 5/60 |
| 4,467,486 | * | 8/1984 | Schatz | 5/53.1 X |
| 5,129,117 | * | 7/1992 | Celestina et al. | 5/602 |
| 5,507,546 | | 4/1996 | Holley | 293/133 |
| 5,611,094 | | 3/1997 | D'Entremont | 5/424 |

* cited by examiner

*Primary Examiner*—Michael F. Trettel
(74) *Attorney, Agent, or Firm*—Pettis & Van Royen, P.A.

(57) ABSTRACT

A deflector for attachment to a vertically adjustable hospital bed so that when the bed is raised or lowered the deflector engages equipment that is attached to the wall and moves the bed frame away from the equipment to prevent damage thereto. The deflector comprises a vertically oriented member having a pair of surfaces that form a predetermined angle with one another so that one surface engages the equipment as the bed is raised and the other surface engages the equipment as the bed is lowered.

14 Claims, 3 Drawing Sheets

DEFLECTOR ATTACHMENT FOR AN ADJUSTABLE BED

BACKGROUND OF THE INVENTION

1. Field of the Invention

The invention relates to the field of attachments to adjustable beds, particularly hospital type beds, that are vertically adjustable. In particular, the invention comprises an attachment that causes the bed to move away from structures attached to the wall adjacent to the head of the bed, as the bed rises or descends, thereby avoiding damage to the bed and the wall structures.

2. Description of the Prior Art

Beds that are vertically adjustable are well known in the industry, and are particularly useful in hospitals. Many such beds have a base that is mounted on wheels for ease of movement of the bed by the hospital staff. To this base is attached a frame that is mounted to the base for vertical movement. To the frame is attached a mattress support that has several parts that independently operate to tilt the head and foot of the mattress to various angles. The bed is normally oriented perpendicular to the wall, with the head of the bed placed as close to the wall as possible to reduce the amount of space occupied by the bed in what is usually a relatively small room. The head of the bed is a convenient location for placement of equipment needed to treat the patient occupying the bed. It is also convenient to attach to the wall, adjacent to the head of the bed, other support equipment, such as utility strips, frequently called "rail systems." An upper rail system usually houses the pipes for transporting medical gases and a lower rail system usually houses the electrical wiring. In addition, the "rail systems" are designed to permit the attachment of other equipment thereto. For example, clips are used to attach the blood pressure units, exam lights, and a nurse's work station to the lower rail, and an overhead light switch, nurse call switch, and staff emergency switch may be attached to the upper rail. Beds are normally kept with the frame in a raised position for ease of patient care by the doctors, nurses and nurse assistants. To make it easier to get in and out of bed, the patient usually lowers the bed to its lowest position. In most cases, the upper rail lies above the frame when the bed is at its maximum height, or upper position, therefore usually there is no conflict between the frame and the upper rail. The lower rail is located on the wall within the range of maximum movement of the bed; therefore, if the bed is not spaced far enough from the wall, the frame will engage the lower rail as the bed is raised or lowered. The bed motors are typically powerful enough so that the lower rail, which is usually constructed from aluminum, is damaged when engaged by the bed frame. Frequently the rail system is torn loose from the wall and the bed frame may also be damaged.

The prior art discloses a number of devices designed to reduce the damage to walls, rail systems, and other items attached to walls. One such device comprises a pair of large wheels that are attached to the frame so that the wheels engage the wall and roll over obstructions attached to the wall.

A second device, disclosed by D'Entremont in U.S. Pat. No. 5,611,094, comprises a U-shaped spacing member that is horizontally oriented and is mounted to and extends outwardly from the bed support at the head of the bed. The U-shaped member engages the wall to keep the head of the bed spaced from the wall so that the bed frame does not cause damage to the wall. This U-shaped member must always be deployed to maintain the spacing from the wall.

This device creates a tripping hazard at the head of the bed and causes the bed to extend further into the room than necessary, thereby occupying precious space.

A third prior art device, as disclosed in U.S. Pat. No. 1,440,783 issued to T. Kiley, comprises a cushioned horizontally oriented U-shaped member that is designed to be attached to a bed frame and project outwardly therefrom so as to engage the wall, preferably the portion of the wall that comprises the baseboard. The cushioned member reduces damage to the wall while keeping the bed spaced away from the wall, wasting valuable room space. When hospital staff members move around the head of a bed to treat a patient, the device is a tripping hazard.

Notwithstanding the existence of such prior art devices, it remains clear that there is a need for a deflector attachment for an adjustable bed that does not create a tripping hazard nor cause the bed to project into the room any farther than absolutely necessary.

SUMMARY OF THE INVENTION

The present invention relates to a deflector for attachment to a vertically adjustable hospital bed. When the bed is raised or lowered, even with the wheels locked, the deflector engages equipment that is attached to the wall and moves the bed frame away from the equipment without damage to the equipment or to the deflector. This invention also prevents damage to the wall, and to the bed frame itself.

Most simply stated, the deflector of this invention comprises a member that is attachable to the frame of an adjustable bed. A first surface is formed on the member, the surface having a first end, a second end and a longitudinal axis. A second surface that has a first end, a second end, and a longitudinal axis is also formed on the member. The first ends of the surfaces are attached to one another at a predetermined angle. The member further comprises a means for attachment to the frame of the bed so that a plane passing through the longitudinal axis of the first and second surfaces is generally perpendicular to a plane passing through the horizontal portion of the frame.

The invention accordingly comprises an article of manufacture possessing the features, properties, and the relation of elements that will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF A PREFERRED EMBODIMENT

Figure 1:
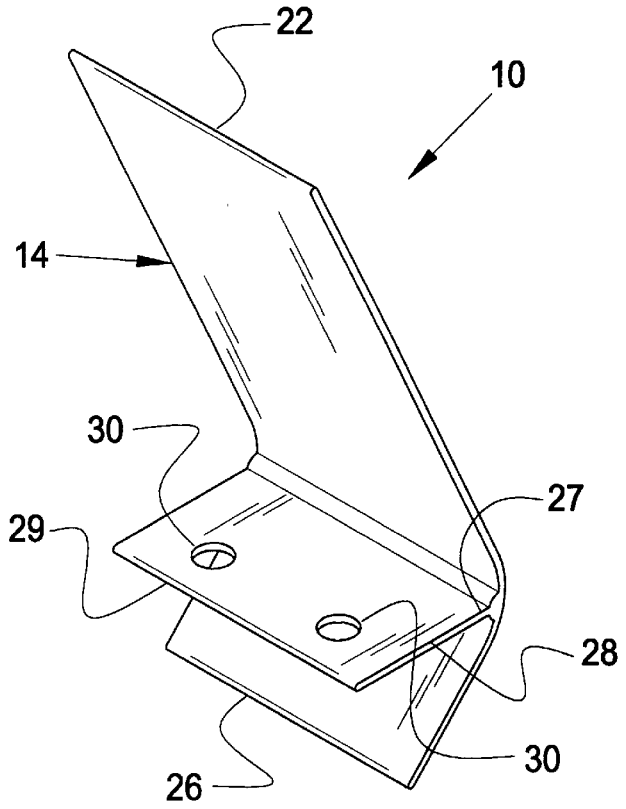
FIG. 1 is an isometric view of a deflector according to this invention.
Figure 2:
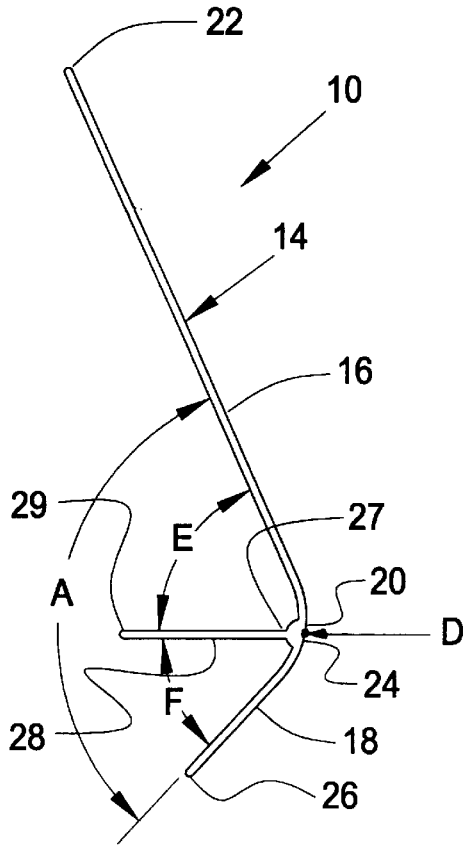
FIG. 2 is a right side elevational view of the invention of FIG. 1.
Figure 3:
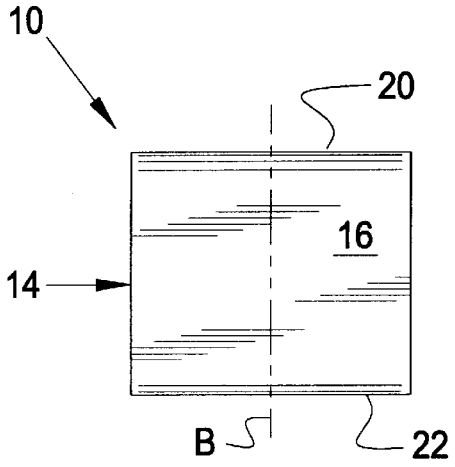
FIG. 3 is a top plan view of the invention.
Figure 4:
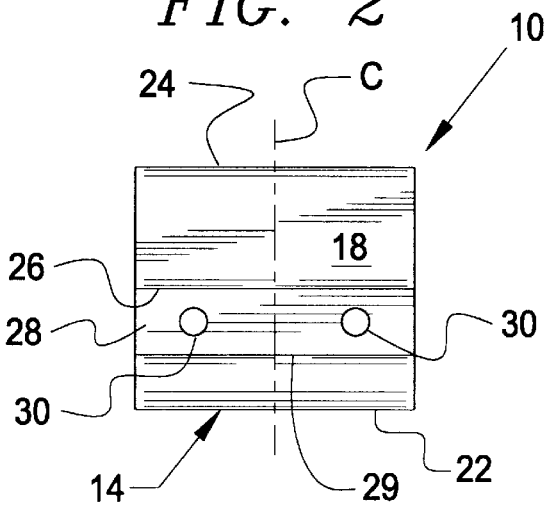
FIG. 4 is a bottom plan view of the invention.
Figure 5:
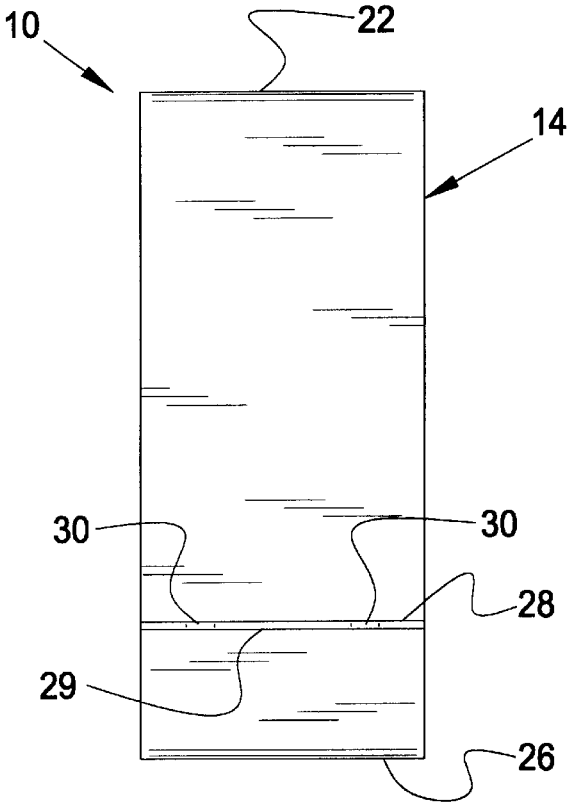
FIG. 5 is a front elevational view of the invention.
Figure 6:
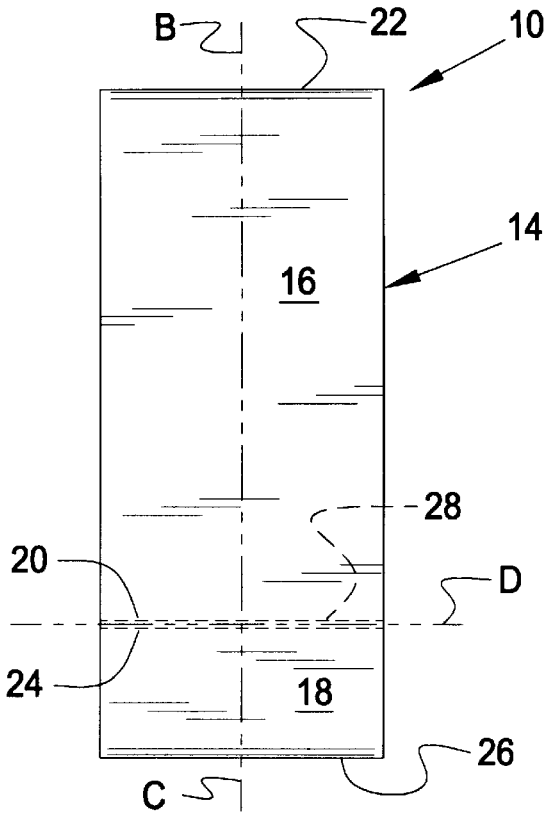
FIG. 6 is a rear elevational view of the invention.

A preferred embodiment for the deflector of this invention is illustrated in the drawing figures. The deflector is generally indicated as 10 in the views of FIGS. 1–10, and a vertically adjustable bed is shown in phantom, generally as 12 in FIGS. 7–9. Referring first to FIGS. 1–4, it can be seen that the deflector 10 comprises a member 14, that has a first surface 16 and a second surface 18. The first surface 16 has a first end 20 and a second end 22, while the second surface 18 has a first end 24 and a second end 26. As illustrated in FIG. 2, the first end 20 of the surface 22 is joined to the first end 24 of the second surface 18. Each of the surfaces 16 and 18 has a longitudinal axis B and C respectively that lies generally perpendicular to the line D formed by the intersection of the first surface 16 and the second surface 18 as seen in FIG. 6. In a preferred embodiment, the first surface 16 and the second surface 18 are generally planar throughout, with the exception that where the surfaces are joined to one another they are arcuate. In other embodiments, the longitudinal axes, B and C of surfaces 16 and 18 may be arcuate. As seen in FIG. 2, the surfaces 14 and 16 are joined to one another at a predetermined angle A. In most preferred embodiments, the size of angle A is greater than 90 degrees.

The shape of the member 14, beyond the relationship between the first surface 16. The second surface 18 with the bed 12, is not critical to the operation of the deflector 10, other than the need for a means to attach the member 14 to the bed 12. In a preferred embodiment, the member 14 is formed from a plate of steel that is sufficiently thick to remain generally rigid when used. In other embodiments, the member 14 may be constructed from other suitable materials, such as hard plastic, with the portion of the member 14 that is interior to the surfaces 16 and 18 having any convenient configuration.

The deflector 10 further comprises a connector that is configured so that the member 14 is attachable to a bed 12. In the embodiment shown in FIGS. 1–9, the connector is conveniently an arm 28 that has a first end 27 that is welded to the member 14 along the line D, as seen in FIG. 6. The second end 29 of the arm 28 has a pair of holes 30 bored therethrough so that the arm 28 can be bolted to the bed 12. The arm 28 is attached to the member 14 so that angle A is subdivided into two smaller angles E and F. The size of angle A for effective operation of the deflector 10 will lie in the range between 108 degrees and 118 degrees; however, in a preferred embodiment the angle A is 113 degrees. The size of angle E and angle F depends largely upon the size of angle A and the placement of the plate 28. In a preferred embodiment, when angle A equals 113 degrees angle E equals 66 degrees and angle F equals 47 degrees so that arm 28 lies generally horizontally for attachment to a horizontal portion of frame 34. The frame 34 is described below.

The use of the deflector 10 is particularly valuable in a hospital setting and will be so described for ease of discussion. However, the deflector 10 is also appropriate for clinics, nursing homes and other like settings where adjustable beds are used. Adjustable hospital beds 12 are designed to aid in the treatment of the patient, to provide easier access to the patient by the hospital staff during treatment, and to increase the comfort of the patient. Patients as a matter of practice receive various treatments while in their hospital rooms, including oxygen, exercise, sponge baths, tests of various types, etc. As a matter of convenience to the doctors or other caretakers, the beds are adjustable to heights above standard beds, so that in the fully raised position the doctors and the hospital staff do not have to bend over to make contact with the patient. Such beds usually have the head of the bed placed adjacent and normal to a generally blank wall. For ease of handling, the hospital beds are mounted on wheels, which causes the beds to migrate toward the wall adjacent the head of the bed, even if the wheels are locked. The head of the bed is a convenient location for placement of the equipment needed to treat a patient, therefor it is also convenient to attach equipment to the wall adjacent to the head of the bed.

Figure 7:
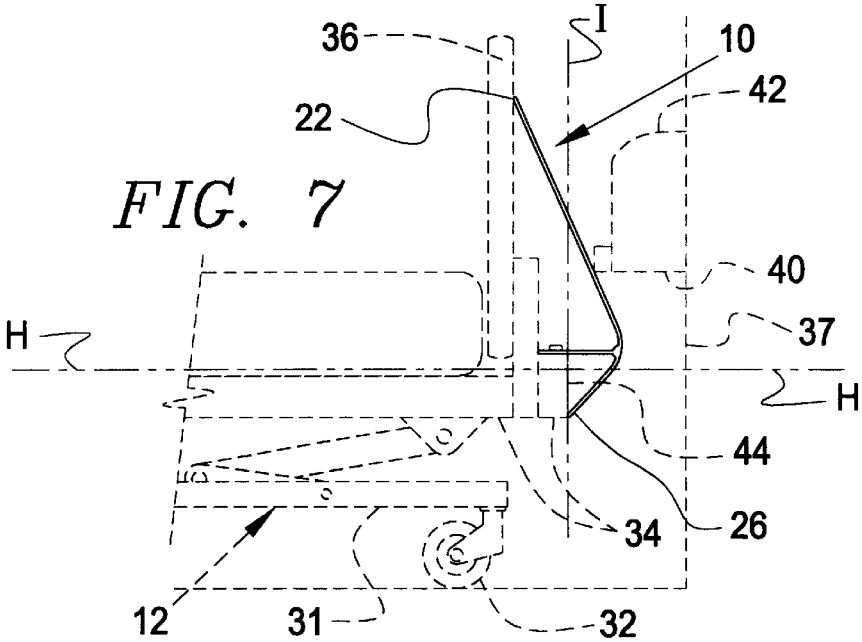
FIG. 7 is a right side elevational view of the deflector attached to an adjustable bed, illustrating the bed proximal to its lower position and moving upwardly, with the deflector engaging wall mounted equipment.
Figure 8:
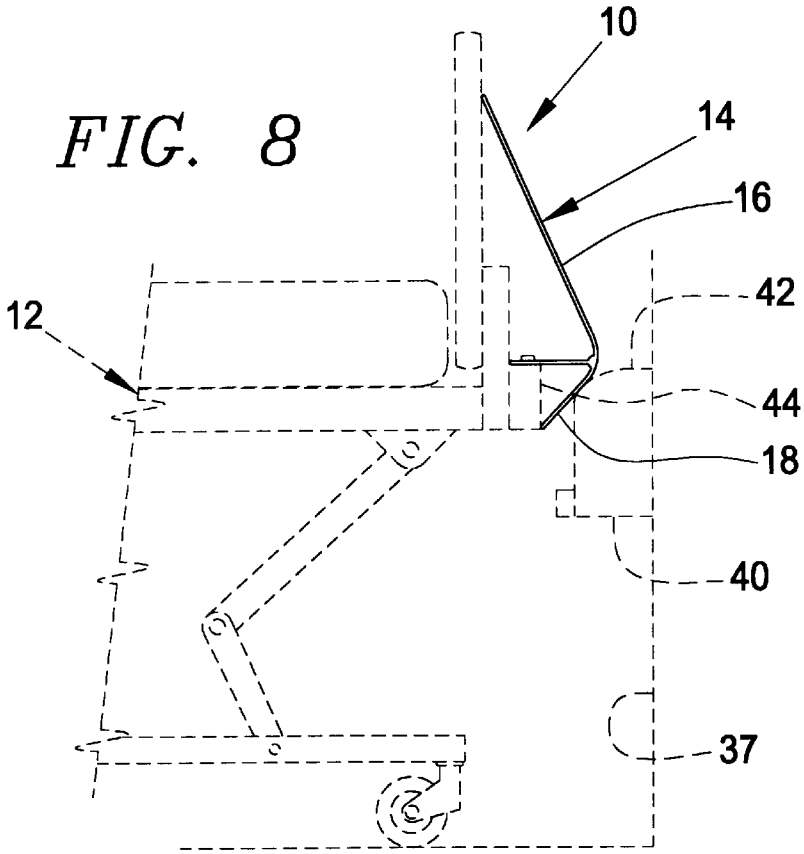
FIG. 8 is a right side elevational view of the deflector as in FIG. 7, but illustrating the bed proximal to its upper position and moving downwardly, with the deflector again engaging wall mounted equipment.
Figure 9:
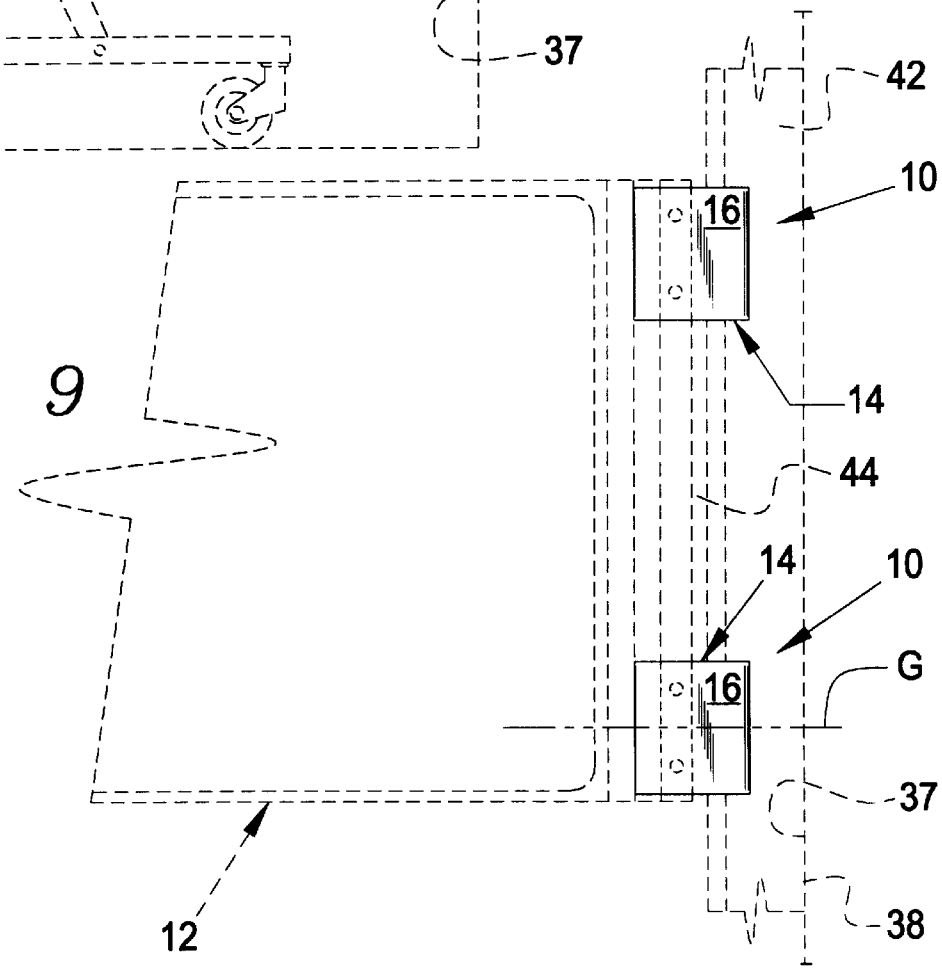
FIG. 9 is a top plan view of FIG. 8 of the invention.

As seen in FIGS. 7–9, adjustable beds comprise: a bed support 31, to which the wheels 32 are attached, a frame 34 that is attached to the bed support 31 for vertical movement of the frame 34, and a mattress support (not shown) that is attached to the frame 34 and has several parts that independently operate to tilt the head and foot of the mattress to various angles. The frame 34 on most adjustable beds 12 extends beyond the mattress support and beyond a head board 36 that is mounted to the frame 34. It is this portion of the frame 34 that is proximal to the head of the bed 12 that is generally in close proximity to the wall 37 of a room. When the frame 34 is raised or lowered in relation to the bed support 31, the frame 34 may contact the equipment 38 that is attached to the wall 37 tearing it from the wall, damaging both the equipment 38, the wall 37, and the frame 34. Each hospital, or other facility, will have its own configuration of equipment that is attached to the wall to support the patient. A typical arrangement of equipment may include rectangular aluminum boxes that extend along the wall, as seen in FIG. 9, which are defined as a lower rail system 38 that primarily houses the electrical distribution lines and an upper rail system (not shown) that houses the pipes for transporting medical gases. In addition, the rail systems are designed to permit the attachment of other equipment thereto. For example, clips are used to attach the blood pressure units, exam lights, and a nurse's work station to the lower rail 38, and an overhead light switch, nurse call switch, and staff emergency switch may be attached to the upper rail. Beds are normally kept with the frame 34 in a raised position, as seen in FIG. 8, for ease of patient care by the doctors, nurses and nurse assistants. To make it easier to get in and out of bed, the patient usually lowers the bed 12 proximal to its lowest position, as seen in FIG. 7. The upper rail usually lies above the frame 34 even when the bed 12 is in its maximum raised, or upper position, therefore there is no conflict between the frame 34 and the upper rail. The lower rail 38 is located on the wall 37 within the range of the maximum movement of the bed 12; therefore, if the bed 12 is not spaced far enough from the wall 37, the frame 34 will engage the rail system 38 as the bed 12 is raised or lowered. The bed motors (not shown) are typically powerful enough that when the frame 34 engages the lower rail system 38 it damages it and frequently tears it from the wall simultaneously damaging the frame 34 and causing damage to the various items attached to the rail system 38.

As can be most clearly seen in FIG. 2, the surface 16 is longer than the surface 18. This particular embodiment of the deflector 10, as illustrated in FIGS. 1–9, is sized and configured for a bed 12 whose frame 34 is approximately 17 inches from the floor in its lowest position, and is approximately 30.5 inches from the floor in its highest position. The bottom 40 of the lower rail 38 is 20 inches from the floor, its top 42 is approximately 29 inches from the floor and it extends out from the wall approximately 4–5 inches. When the bed 12 is in its highest position, the frame 34 has only 1½ inches of vertical travel before the frame 34 would strike the rail 38. With the bed 12 in its lowest position, the frame 34 has approximately three inches of vertical travel before the frame 34 would strike the lower rail. Therefore, there is a need for the first surface 16 to engage the lower rail 38 over a longer distance. To protect this particular configuration of bed 12 and lower rail 38, the surface 16 of the deflector 10 is 12 inches long, and the surface 18 of the deflector 10 is 6 inches long. In this embodiment, the first ends 20 and 24 of surfaces 16 and 18, respectively, are joined to one another with a radius of curvature of approximately $^5/_8$*ths* of an inch. The connector 28 is 4 inches long, but in other embodiments may be any shape and size suitable for attaching the member 14 to the frame 34. With different rail systems, different mounting locations and different beds, the lengths of the surfaces will need to be adjusted. For example, if the lower rail 38 is mounted lower on the wall, the length of surface 18 will have to be lengthened and the length of surface 16 correspondingly shortened. Also, in this embodiment, member 14 and connector 28 are made from a steel plate that is approximately 3 inches wide and ⅛ inch thick. Thus, the member 14 will be generally rigid. In other embodiments, it will be clear to those skilled in the art that other widths and thickness may be used that are suitable for the particular situation.

Having thus set forth a preferred construction for the current invention, it is to the remembered that this is but a preferred embodiment. Attention is now invited to a description of the use of the deflector 10. It is necessary to configure the deflector 10 for the particular style bed and wall mounted equipment. Usually in a hospital, or hospital type facility, there are several styles of beds 12, that may have different ranges of vertical travel, and there may be different styles of rail systems 38. Usually one or two configurations of the deflector 10 will be suitable for most cases. Once the appropriate configuration is determined for a particular arrangement of bed 12 and lower rail 28, including the angles A, E, and F and the lengths of the surfaces 16 and 18, a deflector 10 having the appropriately sized surfaces 14 and 16 and angles will be selected for attachment to the frame 34. In a preferred embodiment, as shown in FIG. 9, a pair of deflectors 10 are mounted to the frame so that they are spaced apart from one another. Using a pair of deflectors 10 prevents the bed from becoming skewed as it moves away from the wall. As shown in FIGS. 7 and 9, the deflectors 10 are mounted to the frame 34 so that a plane G that passes through the longitudinal axes B and C of the first and second surfaces 16 and 18 respectively is generally normal to a plane H that passes horizontally through the frame 34 such that the deflectors 10 are oriented generally vertically. Also, as seen in FIG. 7, the deflectors 10 are mounted to the frame 34 so that the second ends 22 and 26 of the first surface 16 and the second surface 18, respectively, extend toward, and at least one of the surfaces extends through a plane I that passes through the head end 44 of the frame 34.

With the bed 12 in its lowest position, and placed with the head end 44 of the frame 34 proximal to the wall, the first surface 16 will engage the bottom 40 of the lower rail 38, as seen in FIG. 7. As the bed 12 rises a portion of the upward force will be redirected to push outwardly on the bed frame 34 moving the bed away from wall, even with the wheels 32 of the bed 12 are locked. When the bed 12 reaches its maximum height the frame 34 will be above the lower rail 38. Over time it is likely that the bed will be pushed toward the wall so that the frame 34 is now above the top 42 of the lower rail 38, as shown in FIG. 8. When the patient desires to get out of bed he or she will operate the bed's motor (not shown) so that the second surface 18 engages the top 42 of the lower rail 38. Again, as the second surface 18 rides against the lower rail 38 a portion of the downward force is redirected to push the bed away from the wall 37.

While the foregoing describes a particularly preferred embodiment of the present invention, providing a strong and generally rigid structure, it is to be understood that numerous variations and modifications of the structure will readily occur to those skilled in the art. Accordingly, the foregoing description is to be considered illustrative only of the principles of this invention and is not to be considered limitative thereof, the scope of the invention being determined solely by the claims appended hereto.

What is claimed is:

1. A deflector attachment for an adjustable bed comprising:

a member;

a first surface formed on said member, said first surface having a first end, a second end and a longitudinal axis;

a second surface formed on said member, said second surface having a first end, a second end, and a longitudinal axis, said first end of said second surface being joined to said first end of said first surface so that said longitudinal axis of said first surface forms an obtuse angle with said longitudinal axis of said second surface; and an elongated connector for attaching said member to an adjustable bed, said elongated connector being attached to said member within the obtuse angle such that at least a portion of said member extends outwardly, beyond the adjustable bed.

2. A deflector attachment as in claim 1 wherein said elongated connector is so configured that a plane passing through said longitudinal axis of said first surface and through said longitudinal axis of said second surface is generally vertical.

3. A deflector attachment as in claim 1, wherein said elongated connector comprises, an arm having a first end attached to said member and a second end adapted for attachment to said adjustable bed.

4. A deflector attachment as in claim 1, said member being attachable to adjustable bed such that when said member is attached to the adjustable bed, said first ends of said first surface and said second surface are spaced outwardly from the adjustable bed.

5. A defector attachment as in claim 4, wherein said second end of said first surface and said second end of said second surface each extend toward, and at least one of said first and second surfaces passes through, a vertical plane passing through the end of the frame.

6. A deflector attachment as in claim 1, wherein said member is generally rigid.

7. A deflector attachment as in claim 1, wherein said obtuse angle lies within the range of 108 degrees to 118 degrees.

8. A deflector attachment as in claim 1 wherein said connector is so configured that a plane passing through said longitudinal axis of said first surface and through said longitudinal axis of said second surface forms an angle greater than 45 degrees with the horizontal.

9. A deflector attachment for an adjustable bed comprising:

a member;

a first surface formed on said member, said first surface having a first end, a second end and a longitudinal axis;

a second surface formed on said member, said second surface having a first end, a second end, and a longitudinal axis, said first end of said second surface being joined to said first end of said first surface so that said longitudinal axis of said first surface forms a predetermined angle with said longitudinal axis of said second surface; and a connector for attaching said member to an adjustable bed said connector being configured so that a plane passing through said longitudinal axis of said first surface and through said longitudinal axis of said second surface forms an angle greater than 45 degrees with the horizontal.

10. A deflector attachment as in claim 9, wherein said predetermined angle lies within the range of 108 degrees to 118 degrees.

11. A deflector attachment as in claim 9, wherein said connector comprises, an elongated arm having a first end attached to said member and a second end adapted for attachment to said adjustable bed.

12. A deflector attachment for an adjustable bed comprising:

a member;

a first surface formed on said member, said first surface having a first end, a second end and a longitudinal axis;

a second surface formed on said member, said second surface having a first end, a second end, and a longitudinal axis, said first end of said second surface being joined to said first end of said first surface so that said longitudinal axis of said first surface forms a predetermined angle with said longitudinal axis of said second surface; and a connector for attaching said member to an adjustable bed such that when said member is attached to said adjustable bed, said first end of said first surface and said first end of said second surface are each spaced outwardly from the adjustable bed.

13. A deflector attachment as in claim 12, wherein said predetermined angle lies within the range of 108 degrees to 118 degrees.

14. A deflector attachment as in claim 12, wherein said connector is so configured that a plane passing through said longitudinal axis of said first surface and through said longitudinal axis of said second surface forms an angle greater than 45 degrees with the horizontal.

* * * * *